US005806114A

United States Patent [19]

Morgan et al.

[11] Patent Number: 5,806,114

[45] Date of Patent: Sep. 15, 1998

[54] INVALID BED ARRANGEMENT WITH BED PAN FACILITY

[76] Inventors: William D. Morgan, 472 Darlington Rd., Media, Pa. 19063; William A. Morgan, 246 Chestnut Ave., Glen Riddle, Pa. 19063

[21] Appl. No.: 731,282

[22] Filed: Oct. 11, 1996

[51] Int. Cl.[6] ..... A61G 7/02; A61G 7/015

[52] U.S. Cl. ..... 5/604; 5/602; 5/614; 5/618

[58] Field of Search ..... 5/604, 602, 620, 5/618, 614

[56] References Cited

U.S. PATENT DOCUMENTS 4,139,917 2/1979 Fenwick ..... 5/602
5,157,800 10/1992 Borders ..... 5/602

FOREIGN PATENT DOCUMENTS 381163 12/1907 France ..... 5/602

*Primary Examiner*—Alexander Grosz

[57] ABSTRACT

An invalid bed arrangement with bed pan facility including a bed frame. Also included is a seat assembly for allowing a user to be selectively uprighted. The seat assembly further has a bottom portion with U-shaped cut out formed in an end thereof. Further provided is a leg rest assembly adapted to be selectively positioned remote the seat assembly. The leg rest assembly comprises a U-shaped protrusion, whereby the leg rest assembly may be maneuvered between a first orientation with the leg rest situated adjacent the seat assembly and the U-shaped protrusion thereof engaging the U-shaped cut out of the bottom portion of the seat assembly and a second orientation with the leg rest situated distant the seat assembly. Finally, a bed pan is situated adjacent the U-shaped cut out of the bottom portion of the seat assembly.

3 Claims, 5 Drawing Sheets

INVALID BED ARRANGEMENT WITH BED PAN FACILITY

BACKGROUND OF THE INVENTION

1. Field of the Invention

The present invention relates to an invalid bed arrangement with bed pan facility and more particularly pertains to allowing an invalid to conveniently use a bed pan with minimal effort.

2. Description of the Prior Art

The use of hospital beds is known in the prior art. More specifically, hospital beds heretofore devised and utilized for the purpose of allowing the use of bed pans are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,631,762 to Fugett; U.S. Pat. No. 5,355,540 to Allen; U.S. Pat. No. 4,023,218 to Di Matteo; U.S. Pat. No. 4,085,472 to Di Matteo; and U.S. Pat. No. 4,174,547 to Wetzler.

In this respect, the invalid bed arrangement with bed pan facility according to the present invention substantially departs from the conventional concepts and designs of the prior art, and in so doing provides an apparatus primarily developed for the purpose of allowing an invalid to conveniently use a bed pan with minimal effort.

Therefore, it can be appreciated that there exists a continuing need for a new and improved invalid bed arrangement with bed pan facility which can be used for allowing an invalid to conveniently use a bed pan. In this regard, the present invention substantially fulfills this need.

SUMMARY OF THE INVENTION

In view of the foregoing disadvantages inherent in the known types of hospital beds now present in the prior art, the present invention provides an improved invalid bed arrangement with bed pan facility. As such, the general purpose of the present invention, which will be described subsequently in greater detail, is to provide a new and improved invalid bed arrangement with bed pan facility which has all the advantages of the prior art and none of the disadvantages.

To attain this, the present invention essentially comprises a bed frame with a rectilinear configuration. As shown in FIGS. 4–6, the bed frame includes a lower rectangular portion having a pair of parallel lower longitudinal rails with a pair of parallel lower lateral rails perpendicularly coupled therebetween. Associated therewith is an upper rectangular portion having a pair of parallel upper longitudinal rails with a pair of parallel upper lateral rails perpendicularly coupled therebetween. In order to maintain the relative position of the upper and lower rectangular portions, four primary stanchions are vertically coupled between corners of the upper rectangular portion and the lower rectangular portion of the bed frame. For further support, the bed frame further has a plurality of secondary stanchions. Such secondary stanchions include a pair of vertical secondary stanchions and a plurality of skewed secondary stanchions coupled between the lower longitudinal rails and the upper longitudinal rails. For allowing the bed frame to be conveniently transported, a plurality of universal wheels are coupled to the lower rectangular portion of the bed frame. For allowing a user to be selectively uprighted, a seat assembly is provided. As shown in FIGS. 3–6, the seat assembly includes a planar backrest hingably coupled between the upper longitudinal rails of the bed frame at a point ¼ the length of the bed frame from a foot thereof. In use, the backrest has a first raised orientation wherein a plane in which the backrest resides forms a 45 degree angle with respect to a horizontal. The backrest further has a second orientation wherein the plane in which the backrest resides is horizontally situated with edges of the backrest positioned contiguously with the upper rectangular portion of the bed frame. For supporting the posterior of a user, the seat assembly further includes a planar bottom portion hingably coupled at a first end thereof between the upper longitudinal rails of the bed at a point ¼ the length of the bed frame from the foot thereof. As best shown in FIG. 3, the bottom portion of the seat assembly has a U-shaped cut out formed in a second end thereof opposite the first end. Further provided is a planar leg rest assembly adapted to be selectively positioned remote the seat assembly. The leg rest assembly comprises a U-shaped protrusion hingably coupled at a first end thereof and a support mechanism with a generally parallelogram configuration. The support mechanism has a pair of inboard posts hingably coupled to opposite corners of the first end of the leg rest, as best shown in FIGS. 4 & 5. Such inboard posts have a first predetermined length. The support mechanism further includes a pair of outboard posts hingably coupled to opposite corners of a second end of the leg rest with a second predetermined length greater than the first length. By this structure, the posts are adapted to rotate solely within a vertical plane. For ensuring that the posts rotate coincidentally, the support mechanism further includes a rectangular structure coupled between lower ends of the posts thereof. Associated therewith is a pair of positioning posts coupled between the rectangular structure of the support mechanism and a midpoint of the longitudinal rails of the upper rectangular portion of the bed frame. As such, the positioning posts ensure the proper maneuvering of the support mechanism of the leg rest assembly between a first orientation and a second orientation. The first orientation is defined by the leg rest being situated in coplanar relationship with the bottom portion of the seat assembly and the U-shaped protrusion thereof engaging the U-shaped cut out of the bottom portion of the seat assembly. The second orientation is defined by the leg rest being situated beneath the bottom portion of the seat assembly. As shown in FIG. 3, a bed pan is coupled to the upper rectangular portion of the bed frame beneath the bottom portion of the seat assembly. In use, the bed pan has a first orientation distant the U-shaped cut out of the bottom portion of the seat assembly for allowing the maneuvering of the leg rest assembly and a second orientation situated within the U-shaped cut out of the bottom portion of the seat assembly for use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved invalid bed arrangement with bed pan facility which has all the advantages of the prior art hospital beds and none of the disadvantages.

It is another object of the present invention to provide a new and improved invalid bed arrangement with bed pan facility which may be easily and efficiently manufactured and marketed.

It is a further object of the present invention to provide a new and improved invalid bed arrangement with bed pan facility which is of a durable and reliable construction.

An even further object of the present invention is to provide a new and improved invalid bed arrangement with bed pan facility which is susceptible of a low cost of manufacture with regard to both materials and labor, and which accordingly is then susceptible of low prices of sale to the consuming public, thereby making such invalid bed arrangement with bed pan facility economically available to the buying public.

Still yet another object of the present invention is to provide a new and improved invalid bed arrangement with bed pan facility which provides in the apparatuses and methods of the prior art some of the advantages thereof, while simultaneously overcoming some of the disadvantages normally associated therewith.

Still another object of the present invention is to allow an invalid to conveniently use a bed pan.

Lastly, it is an object of the present invention to provide a new and improved invalid bed arrangement with bed pan facility including a bed frame. Also included is a seat assembly for allowing a user to be selectively uprighted. The seat assembly further has a bottom portion with U-shaped cut out formed in an end thereof. Further provided is a leg rest assembly adapted to be selectively positioned remote the seat assembly. The leg rest assembly comprises a U-shaped protrusion, whereby the leg rest assembly may be maneuvered between a first orientation with the leg rest situated adjacent the seat assembly and the U-shaped protrusion thereof engaging the U-shaped cut out of the bottom portion of the seat assembly and a second orientation with the leg rest situated distant the seat assembly. Finally, a bed pan is situated adjacent the U-shaped cut out of the bottom portion of the seat assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
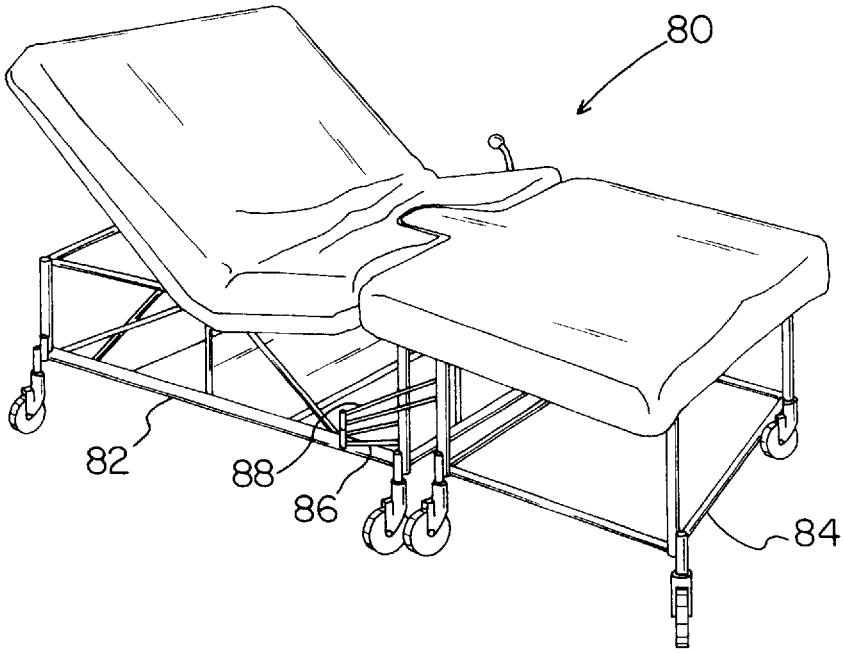
FIG. 1 is a perspective illustration of an alternate embodiment of the invalid bed arrangement with bed pan facility constructed in accordance with the principles of the present invention.

With reference now to the drawings, and in particular to FIG. 1 thereof, a new and improved invalid bed arrangement with bed pan facility embodying the principles and concepts of the present invention and generally designated by the reference numeral 10 will be described.

The present invention, the new and improved invalid bed arrangement with bed pan facility, is comprised of a plurality of components. Such components in their broadest context include a bed frame, seat assembly, seat assembly drive mechanism, leg rest assembly, leg rest assembly drive mechanism, and bed pan. Such components are individually configured and correlated with respect to each other so as to attain the desired objective.

Figure 4:
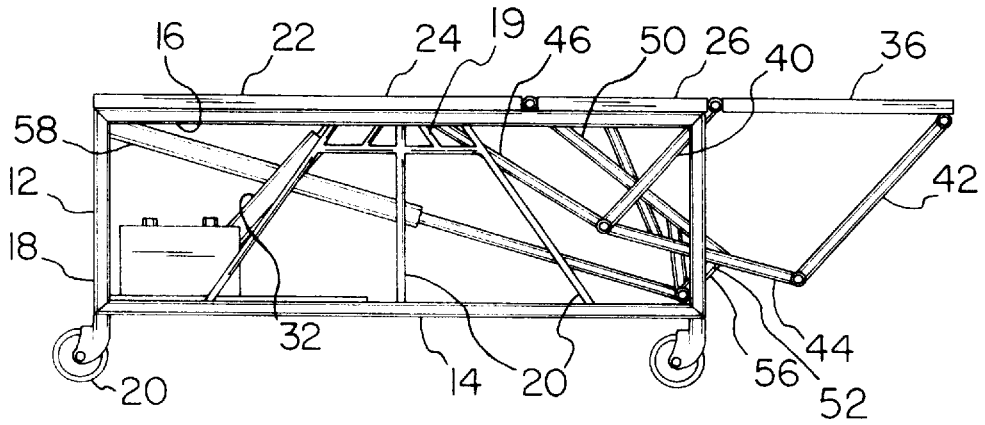
FIG. 4 is a side view of the invention shown in FIG. 3 with the leg rest assembly situated adjacent the seat assembly.
Figure 5:
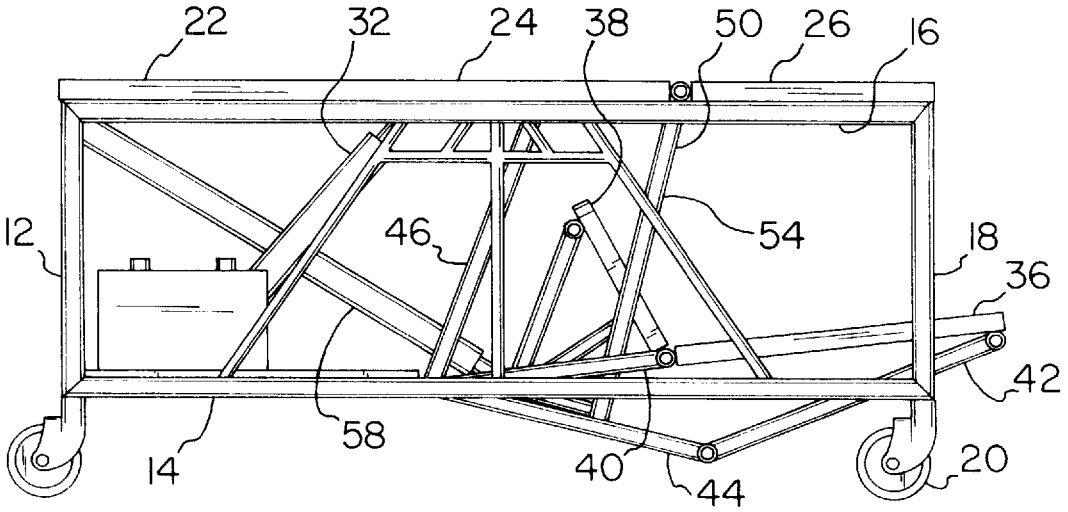
FIG. 5 is another side view of the present invention with the leg rest assembly residing distant the seat assembly.
Figure 6:
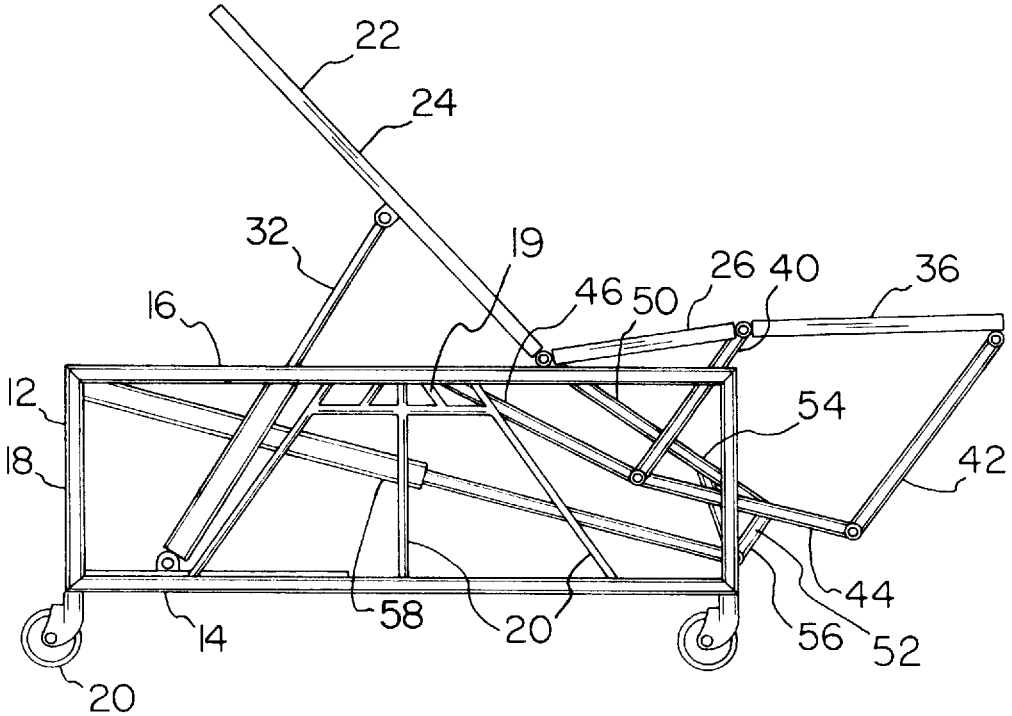
FIG. 6 is a side view of the present invention with the backrest in an elevated orientation.
Figure 7:
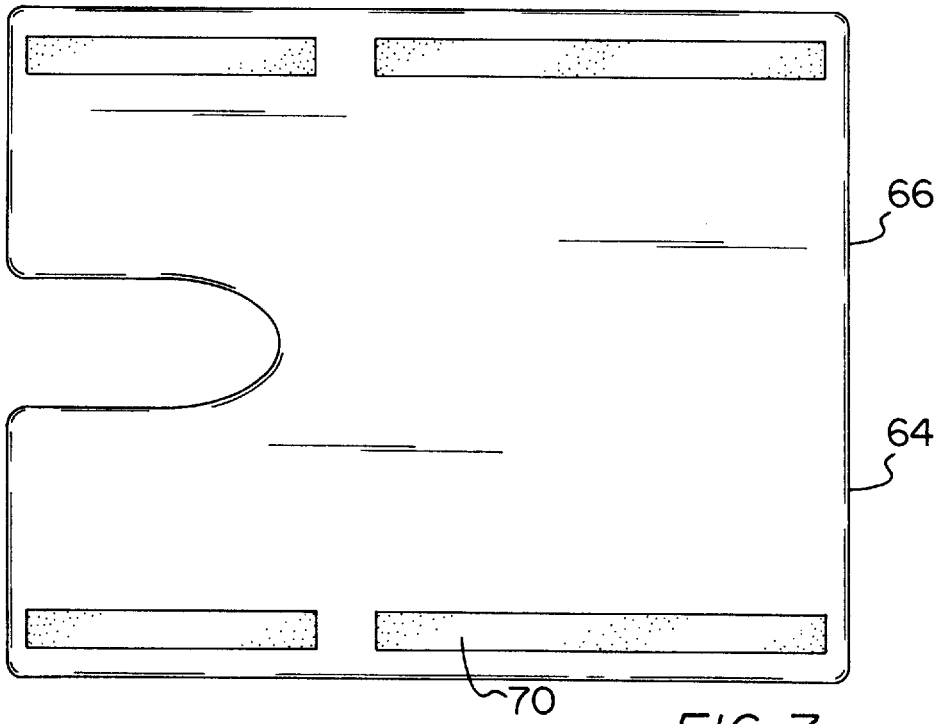
FIG. 7 is a bottom view of the first mattress of the present invention.
Figure 8:
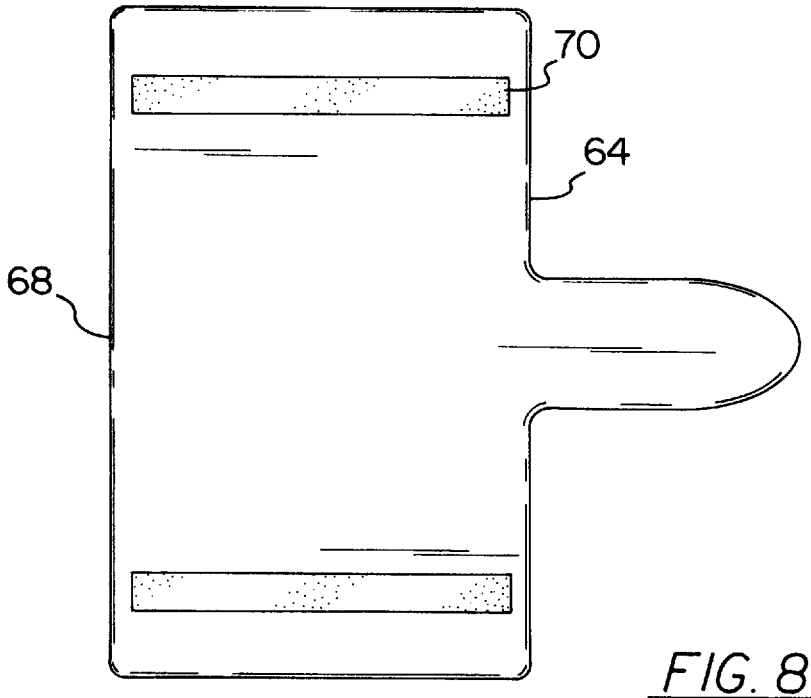
FIG. 8 is a bottom view of the second mattress of the present invention.

More specifically, it will be noted that the system 10 of the present invention includes a bed frame 12 with a rectilinear configuration. As shown in FIGS. 4–6, the bed frame includes a lower rectangular portion 14 having a pair of parallel lower longitudinal rails with a pair of parallel lower lateral rails perpendicularly coupled between corners thereof. Associated therewith is an upper rectangular portion 16 having a pair of parallel upper longitudinal rails with a pair of parallel upper lateral rails perpendicularly coupled therebetween. In order to maintain the relative position of the upper and lower rectangular portions, four primary stanchions 18 are vertically coupled between corners of the upper rectangular portion and the lower rectangular portion of the bed frame. For further support, the bed frame further has a plurality of secondary stanchions 20. Such secondary stanchions include a pair of vertical secondary stanchions coupled between the lower longitudinal rails and the upper longitudinal rails at midpoints thereof. A plurality of skewed secondary stanchions are also coupled between the lower longitudinal rails and the upper longitudinal rails. A web 19 is included to provide additional strength on top ends of the secondary stanchions. For allowing the bed frame to be conveniently transported, a plurality of universal wheels 20 are coupled to the lower rectangular portion of the bed frame.

Figure 3:
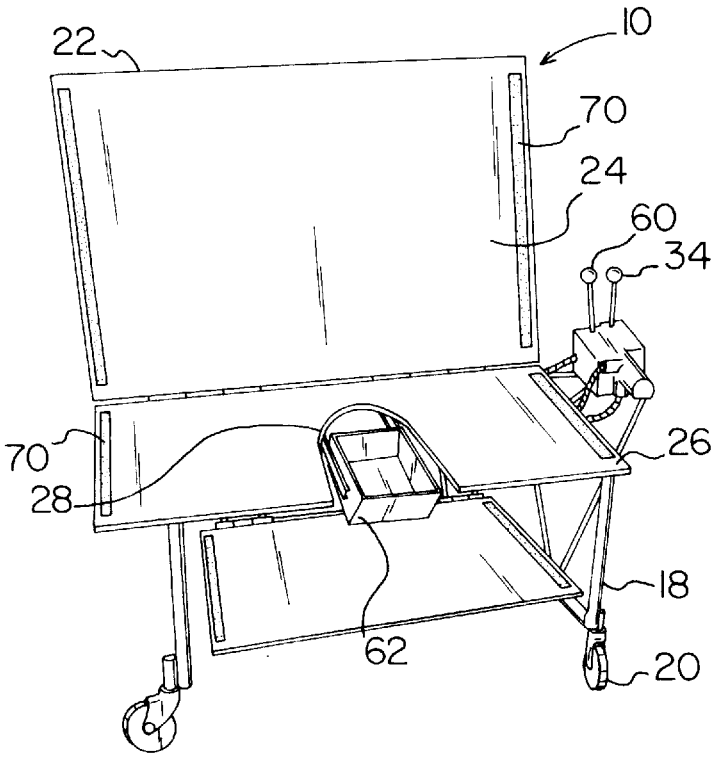
FIG. 3 is an elevational view of the first embodiment of the present invention.

For allowing a user to be selectively uprighted, a seat assembly 22 is provided. As shown in FIGS. 3–6, the seat assembly includes a planar backrest 24 hingably coupled between the upper longitudinal rails of the bed frame at a point ¼ the length of the bed frame from a foot thereof. In use, the backrest has a first raised orientation wherein a plane in which the backrest resides forms a 45 degree angle with respect to a horizontal. The backrest further has a second orientation wherein the plane in which the backrest resides is horizontally situated with edges of the backrest positioned contiguously with the upper rectangular portion of the bed frame. For supporting the posterior of a user, the seat assembly further includes a planar bottom portion 26 hingably coupled at a first end thereof between the upper longitudinal rails of the bed at a point ¼ the length of the bed frame from the foot thereof. As best shown in FIG. 3, the bottom portion of the seat assembly has a U-shaped cut out 28 formed in a second end thereof opposite the first end. Such U-shaped cut out functions as a toilet structure.

With reference to FIGS. 4–6, a seat assembly drive mechanism 30 is included with a hydraulic arm 32. The hydraulic arm is coupled between a central portion of the backrest and the lower rectangular portion of the bed frame. Positioned adjacent the bed frame is a lever 34 adapted to selectively extend the hydraulic arm thereby selectively maneuvering the backrest between the first orientation and the second orientation thereof.

Further provided is a planar leg rest assembly 36 adapted to be selectively positioned remote the seat assembly. The leg rest assembly comprises a U-shaped protrusion 38 hingably coupled at a first end thereof and a support mechanism with a generally parallelogram configuration. The support mechanism has a pair of inboard posts 40 hingably coupled to opposite corners of the first end of the leg rest, as best shown in FIGS. 4 & 5. Such inboard posts have a first predetermined length. The support mechanism further includes a pair of outboard posts 42 hingably coupled to opposite corners of a second end of the leg rest with a second predetermined length greater than the first length. By this structure, the posts are adapted to rotate solely within a vertical plane. For ensuring that the posts rotate coincidently, the support mechanism further includes a rectangular structure 44 coupled between lower ends of the posts thereof. Associated therewith is a pair of positioning posts 46 coupled between the rectangular structure of the support mechanism and a midpoint of the longitudinal rails of the upper rectangular portion of the bed frame. As such, the positioning posts ensure the proper maneuvering of the support mechanism of the leg rest assembly between a first orientation and a second orientation. The first orientation is defined by the leg rest being situated in coplanar relationship with the bottom portion of the seat assembly and the U-shaped protrusion thereof engaging the U-shaped cut out of the bottom portion of the seat assembly. The second orientation is defined by the leg rest being situated beneath the bottom portion of the seat assembly.

For controlling the maneuvering of the leg rest assembly, a leg rest assembly drive mechanism 50 is included. The leg rest assembly drive mechanism includes a pair of L-shaped drive arms 52 each with an elongated first leg 54 pivotally coupled at a first end thereof to the upper rectangular portion of the bed frame adjacent an interconnection of the backrest and the bottom portion of the seat assembly. Each drive arm further includes a second end pivotally coupled to a central portion of the rectangular structure. Each L-shaped drive arm also has a second short leg 56 extending perpendicularly from the first elongated leg. A hydraulic arm 58 is coupled between a head of the upper rectangular portion of the bed frame and the second short leg of the drive arms. Positioned adjacent the bed frame next to the previous lever is another lever 60 adapted to extend the hydraulic arm thereby selectively maneuvering the leg rest between the first orientation and the second orientation thereof. As shown in FIG. 6, the U-shaped protrusion may be engaged within the U-shaped cut out and further the drive mechanism may be extended to its maximum extent for elevating both the bottom portion of the seat assembly and the leg rest assembly above a horizontal plane.

Figure 10:
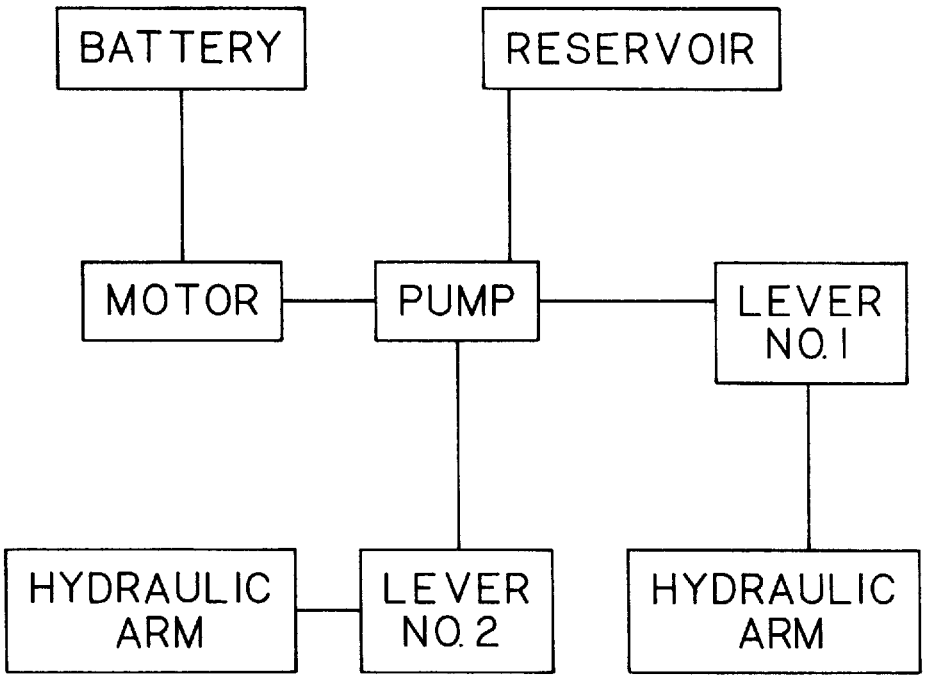
FIG. 10 is a schematic diagram showing the interconnection of various components of the present invention.

The hydraulic arms of the present invention have an associated pump which is powered by a battery, as shown in FIG. 10. While hydraulics are employed in the present invention, it should be noted that other sources of mechanical work may be employed such as electrical motors and the like.

Figure 9:
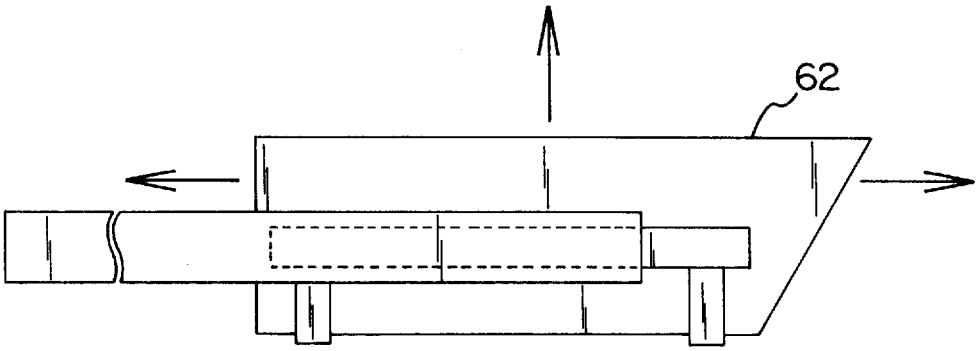
FIG. 9 is a side view of the bed pan.

As shown in FIG. 3, a bed pan 62 is coupled to the upper rectangular portion of the bed frame beneath the bottom portion of the seat assembly. In use, the bed pan has a first orientation distant the U-shaped cut out of the bottom portion of the seat assembly for allowing the maneuvering of the leg rest assembly and a second orientation situated within the U-shaped cut out of the bottom portion of the seat assembly for use. As shown in FIG. 9, it is shown that the bed pan mounted on a retracting mechanism which allows both vertical and horizontal movement thereof.

Finally, a pair of mattresses 64 are included comprising a first mattress 66 and a second mattress 68. The first mattress is capable of covering both the backrest and the bottom portion of the seat assembly wherein the first mattress has a U-shaped cut out situated contiguously with the U-shaped cut out of the bottom portion of the seat assembly. The second mattress is capable of covering the leg rest assembly. The second mattress has a U-shaped protrusion situated contiguously with the U-shaped protrusion of the leg rest assembly. For allowing the removable coupling of mattresses to the respective assembly, the mattresses, seat assembly and the leg rest assembly are equipped with pile fasteners 70 situated thereon.

Figure 2:
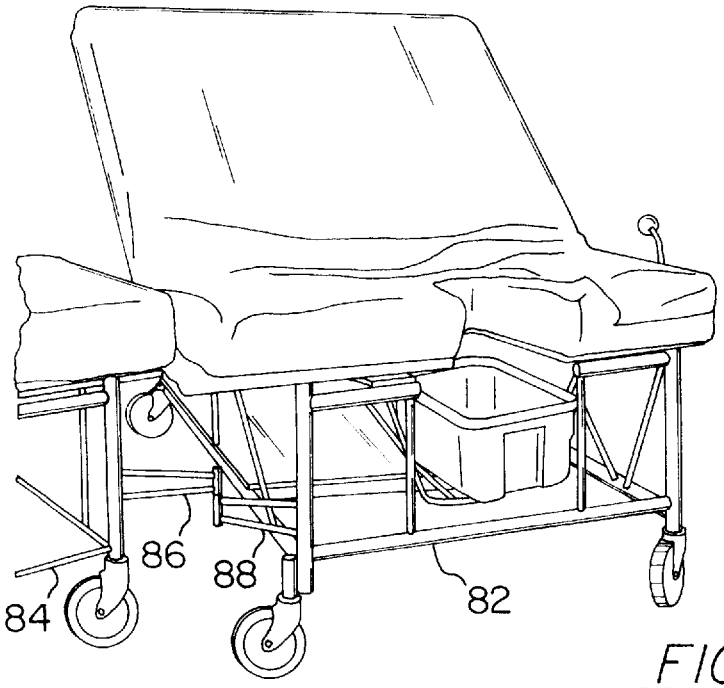
FIG. 2 is yet another perspective view of the alternate embodiment with the leg rest assembly situated distant the seat assembly.

As shown in FIGS. 1 & 2, an alternate embodiment 80 is set forth which employs an alternate method of situating the leg rest assembly distant the seat assembly during use of the bed pan. Such method takes the place of the support mechanism of the leg rest assembly and further the leg assembly drive mechanism. In such embodiment, the seat assembly is situated on a first bed frame 82 with universal wheels situated thereon. The bed pan is fixed below the U-shaped cut out of the seat assembly. See FIG. 1. The leg rest assembly is situated on a second bed frame 84 with universal wheels situated thereon, wherein the leg rest assembly may be slidably situated distant the seat assembly for allowing use of the bed pan. Further provided is a coupling mechanism 86 for maintaining the leg rest within the proximity of the seat assembly during use of the bed pan. Such coupling mechanism includes a pair of members 88 extending perpendicularly from the bed frames of each assembly, wherein the members are pivotally coupled at ends thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An invalid bed arrangement with bed pan facility comprising:

a seat assembly (22) for allowing a user to be selectively uprighted, the seat assembly including a U-shaped cut out (28) formed therein and a bottom portion;

a leg rest assembly (36) adapted to be selectively positioned remote the seat assembly, the leg rest assembly comprising a U-shaped protrusion (38), whereby the leg rest assembly may be maneuvered between a first orientation with the leg rest situated adjacent the seat assembly and the U-shaped protrusion thereof engaging the U-shaped cut out of the, seat assembly and a second orientation with the leg rest situated distant the seat assembly; and a bed pan (62) situated adjacent the U-shaped cut out and the bottom portion of the seat assembly wherein the seat assembly is situated on a first bed frame (82) with universal wheels situated thereon; and wherein the bed pan (62) is fixed below the U-shaped cut out of the seat assembly; and wherein the leg rest assembly is situated on a second bed frame (84) with universal wheels situated thereon, wherein the leg rest assembly may be slidably situated distant the seat assembly for allowing use of the bed pan;

a coupling mechanism (86) for maintaining the leg rest within the proximity of the seat assembly during use of the bed pan; and wherein the coupling mechanism includes a pair of members (88) extending perpendicularly from the bed frames of each assembly, wherein the members are pivotally coupled at ends thereof.

2. An invalid bed arrangement with bed pan facility as set forth in claim 1 and further including a pair of mattresses comprising a first mattress capable of covering the seat assembly wherein the first mattress has a U-shaped cut out situated contiguously with the U-shaped cut out of the seat assembly and a second mattress capable of covering the leg rest assembly with the second mattress having a U-shaped protrusion situated contiguously with the U-shaped protrusion of the leg rest assembly, wherein the mattresses, seat assembly and the leg rest assembly have pile fasteners situated thereon for allowing the removable coupling of mattresses to the respective assembly.

3. An invalid bed arrangement with bed pan facility as set forth in claim 1 and further including a bed frame with a lower rectangular portion having a pair of parallel lower longitudinal rails with a pair of parallel lower lateral rails perpendicularly coupled therebetween, an upper rectangular portion having a pair of parallel upper longitudinal rails with a pair of parallel upper lateral rails perpendicularly coupled therebetween, and four primary stanchions vertically coupled between corners of the upper rectangular portion and the lower rectangular portion of the bed frame.

* * * * *